United States Patent [19]

Bruckner et al.

[11] 4,166,561

[45] Sep. 4, 1979

[54] APPARATUS FOR TREATING A WEB OF TEXTILE MATERIAL IN A DWELL ZONE

[75] Inventors: Kurt Bruckner, Bad Konig; Manfred Schuierer, Michelstadt, both of Fed. Rep. of Germany

[73] Assignee: Bruckner Apparatebau GmbH, Erbach, Fed. Rep. of Germany

[21] Appl. No.: 865,945

[22] Filed: Dec. 30, 1977

[30] Foreign Application Priority Data

Jan. 13, 1977 [DE] Fed. Rep. of Germany ..... 2701275
Oct. 12, 1977 [DE] Fed. Rep. of Germany ..... 2745901

[51] Int. Cl.[2] ..... B65H 17/42; D06B 23/04

[52] U.S. Cl. ..... 226/105; 34/157; 68/5 D; 226/118

[58] Field of Search ..... 68/5 D, 5 E, 158, 177; 226/104–107, 118; 34/157

[56] References Cited

U.S. PATENT DOCUMENTS

| | | | |
|---|---|---|---|
| 2,205,539 | 6/1940 | Owen | 34/157 |
| 2,436,719 | 2/1948 | Hurxthal | 34/157 X |
| 2,612,770 | 10/1952 | Fahringer | 68/158 X |
| 2,993,356 | 7/1961 | Archibald | 226/104 X |

*Primary Examiner*—Philip R. Coe
*Attorney, Agent, or Firm*—Marshall & Yeasting

[57] ABSTRACT

Apparatus for treating a web of textile material in a dwell zone comprises means for guiding around a closed circuit a plurality of suspension bars for carrying loops of the web of material. The web is fed downward at a fixed entrance point in such circuit to cause each passing suspension bar to pick up a loop of the web and is withdrawn continuously at a point in such circuit immediately preceding such entrance point.

6 Claims, 4 Drawing Figures

APPARATUS FOR TREATING A WEB OF TEXTILE MATERIAL IN A DWELL ZONE

BACKGROUND OF THE INVENTION

This invention relates to an apparatus for treating, particularly steaming, a web of textile material in a dwell zone, comprising a plurality of suspension bars guided around a continuous circuit, for receiving a web of material travelling in loops over the suspension bars.

Certain treatments of textile webs, for example steaming, are carried out in a dwell zone. The dwell zone should be constructed as far as possible in such a way that the web of material, which is introduced and removed continuously, dwells as long as possible in the smallest possible space without at the same time being subjected to harmful stressing, particularly in the form of undesirable creasing.

A known apparatus designed for this purpose comprises a plurality of conveyor belts generally arranged one above the other, the web of material being deposited in folds onto the conveyor belts. The principal disadvantage of apparatus of this type is the irregularity of the treatment (danger of streak formation) attributable to the folding of the web material.

In addition, so-called tunnel steamers are known in which the web of material is guided in loops over a plurality of fixedly arranged guide rollers. The principal disadvantage of tunnel steamers is their considerable overall length.

The same disadvantage is also encountered in known festoon steamers in which the web of material which is introduced at one end of the apparatus and removed at its other end is guided in loops over a plurality of suspension bars. These suspension bars travel around a closed circuit; in other words they are returned empty from the take-off end of the apparatus to the input end thereof. In apparatus such as this, too, a desirable length of the dwell zone presupposes considerable dimensions of the apparatus.

SUMMARY OF THE INVENTION

Accordingly, the object of the present invention is to obviate the disadvantages of known apparatus by achieving a long dwell in a confined space whilst, at the same time, providing for careful treatment of the web of material (i.e., in particular without subjecting it to troublesome creasing).

According to the invention, this object is achieved in that the distance between the point at which the web is removed, as seen in the direction of movement of the suspension bars, and the point at which it is introduced is substantially equivalent to one complete circuit of the suspension bars. In this way, the careful treatment required for the web of material can be obtained in a confined space in a long dwell zone.

In one embodiment of the invention, the suspension bars are arranged around the circumference of a rotor having a horizontal axis, and are guided by the rotor along a circular path.

In a second embodiment of the invention, the path followed by the suspension bars has an elliptical form with a substantially horizontal major axis, and the points at which the web of material is introduced and removed are arranged off-center—staggered against the direction of circulation of the suspension bars—in the upper zone of the path.

In this way, allowance is made in particular for the fact that, in some cases, particularly in the steaming of high-shrinkage textile webs, it is desirable for the web of material in the dwell zone initially to hang freely in the loops for a prolonged period.

In this particular embodiment of the apparatus, the web of material initially travels from its point of introduction through the upper zone of the elongated circuit, the loops of the web of material hanging freely from the bars in this zone. Accordingly, after it has been introduced into the apparatus, the web of material is able to undergo free, unimpeded shrinkage over a relatively long dwell time, i.e., for the entire period during which it passes through the upper zone of the elongated circuit.

This embodiment has the further significant advantage that the points at which the textile web rests on the suspension bars can be shifted over a prolonged period after introduction of the web into the apparatus (i.e., during the passage through the upper zone of the elongate circuit) by rotating the suspension bars in the upper zones of the circuit. By shifting the suspension points in this way, it is possible to prevent unequal shrinkage and uneven thermal stressing of the web and, hence, to obtain a significant improvement in quality.

As will be explained in more detail with reference to three embodiments, it is possible in this way to obtain maximum length of the dwell zone for the apparatus of given overall dimensions, coupled with simple construction, whilst at the same time providing for careful treatment of the web material.

DESCRIPTION OF THE PREFERRED EMBODIMENTS

Figure 1:
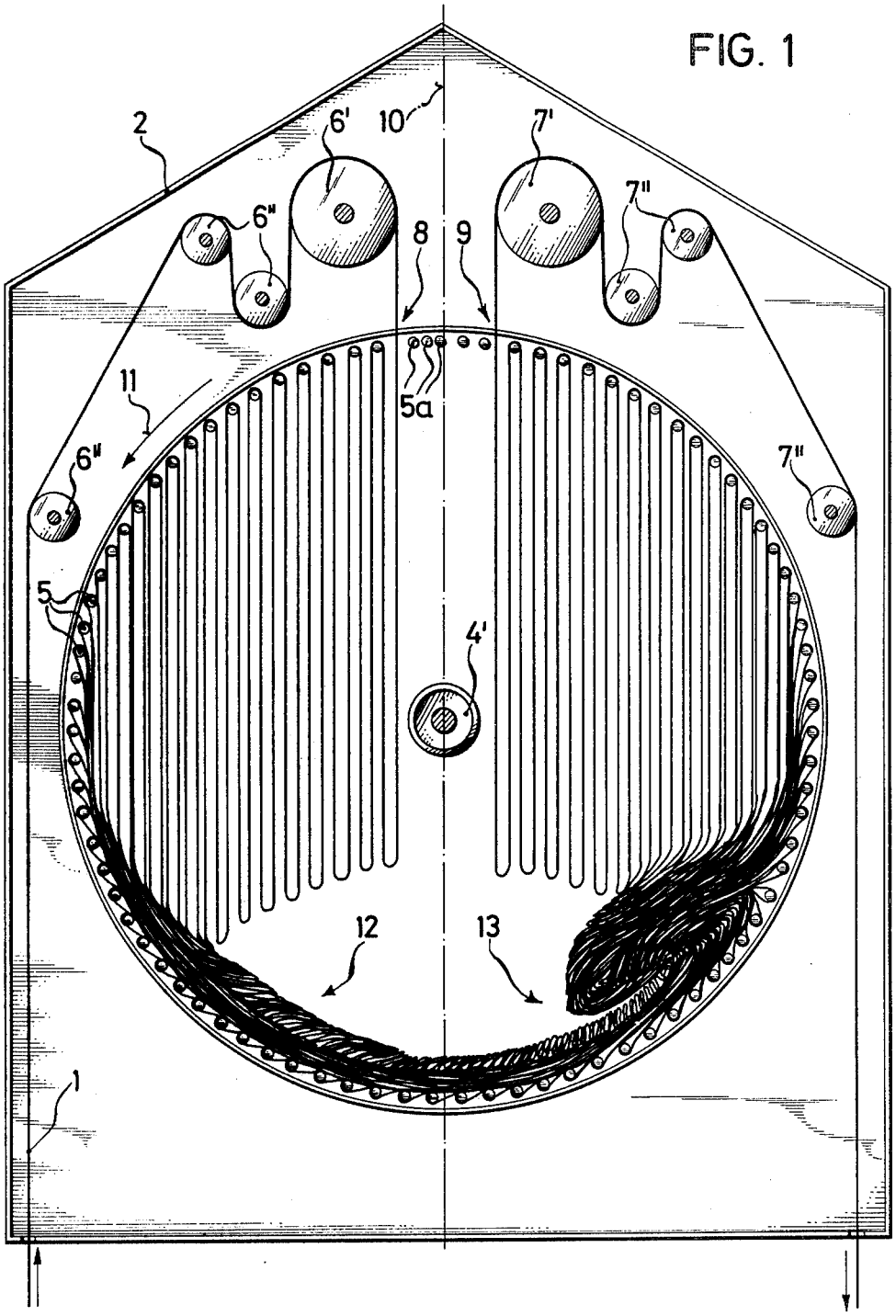
FIGS. 1 and 2 are cross-sections of two embodiments of the invention in which the suspension bars follow a circular path.

The apparatus shown in FIG. 1 for steaming a web 1 of textile material comprises, in a housing 2, a rotor which is rotatable about a horizontal axle 4' and which carries a plurality of suspension bars 5 around its circumference. The web 1 is delivered to the rotor by way of a plurality of guide rollers 6' and 6'' and is removed from the rotor by other guide rollers 7' and 7''.

In the embodiment illustrated in FIG. 1, the point 8 at which the web is introduced is situated at one side of the vertical median plane 10 of the apparatus, which passes through the rotor axis. The direction of rotation of the rotor is indicated by the arrow 11. Shortly before the point 8 at which the web is introduced, the suspension bars (for example at 5*a*) are held back somewhat in the manner shown in FIG. 1, so that a widened gap for the exact introduction of the web 1 is obtained at the point of introduction 8.

This embodiment of the apparatus, shown in FIG. 1 operates as follows:

At the entrance point 8, the web 1 of textile material is placed in loops over the empty suspension bars 5*a* approaching from the right. The size of the loops is such that they extend into the lower half of the interior of the rotor. As the rotor rotates (either continuously or intermittently), a loop formed from the web 1 initially depends freely in the rotor until, after the suspension for supporting the loop has traversed a certain angle of rotation, the loop is deposited to an increasing extent on the inner circumference of the rotor or onto the layers of the web 1 already present there (cf. zone 12). During the further rotation of the rotor, the leading end of each loop reaches a zone 13 in which the individual loops turn over inwards and reform in a different position on the suspension bars 5. As the rotor continues to rotate, the newly formed loops again depend freely in the interior of the rotor 3 until they are withdrawn at the exit 9.

Figure 2:
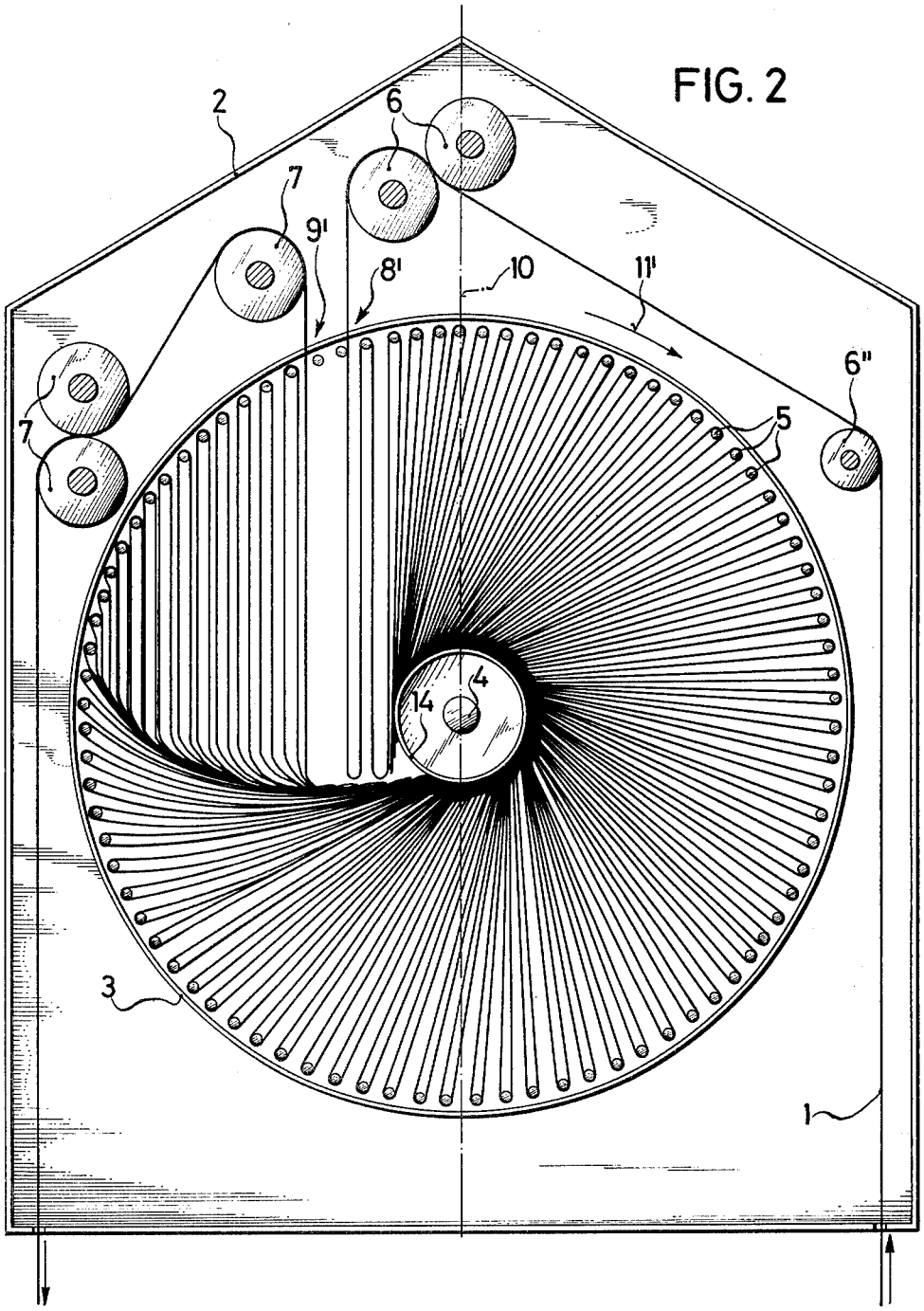

In the embodiment shown in FIG. 2, which is a modification of the embodiment shown in FIG. 1, a central tube 14 is provided in the interior of the rotor 3 and preferably rotates together with the rotor 3 about the axle 4.

In this embodiment, the entrance 8' and exit 9' for the web of material are arranged on the same side of the vertical median plane 10, the entrance 8' being situated between the exit 9' and the vertical median plane 10. The direction of rotation of the rotor 3 is indicated by the arrow 11'.

The web 1 of material is again introduced by way of guide rollers 6', 6'' and removed by way of guide rollers 7.

In the embodiment shown in FIG. 2, the horizontal distance between the entrance 8' for the web of material and the vertical median plane 10 is slightly greater than the radius of the central tube 14. As a result, a few freely depending loops of the web are initially formed in the region of the entrance 8'. As the rotor 3 continues its rotation, these loops are deposited on the central tube 14 in the manner shown in the drawing, so that the central tube 14 supports and guides the loops during the rotation of the rotor 3. Accordingly, during the first half of a revolution of the rotor 3, a loop extends substantially tangentially to the circumference of the central tube 14 from the respective suspension bar 5. During the further rotational movement, i.e., in the second half of a revolution, the loop gradually reverts from this tangential position to a substantially vertical position from which it is finally removed in the region of the exit 9'.

Figure 3:
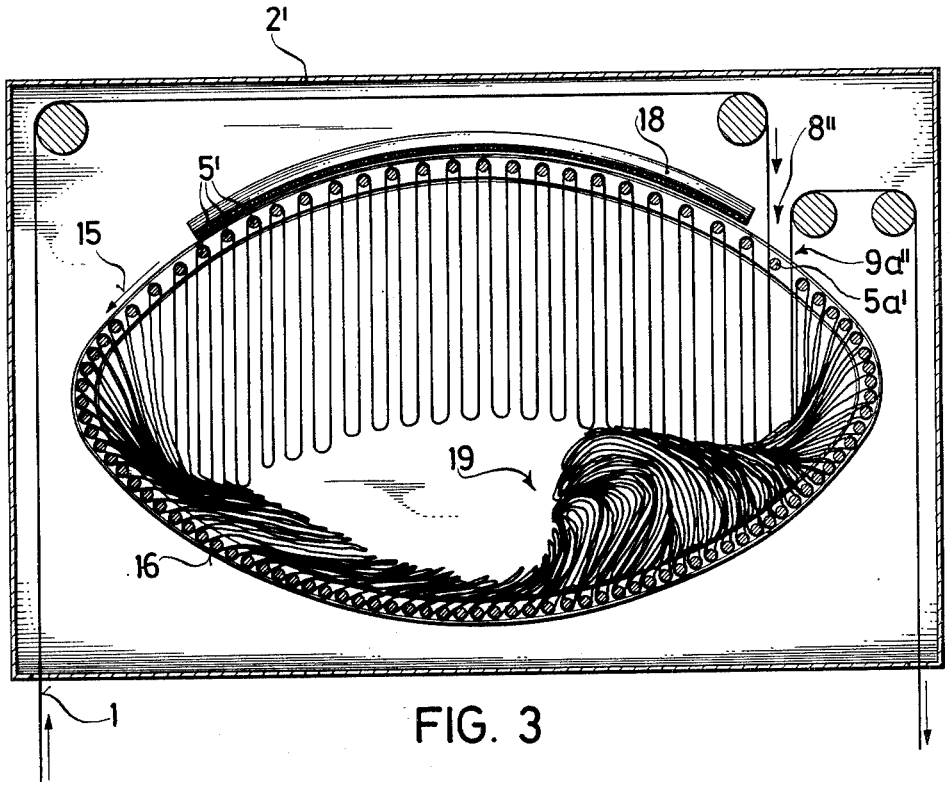
FIG. 3 is a cross-section of another embodiment of the invention in which the suspension bars follow an elongate, substantially elliptical path.

The apparatus for steaming a web 1 of textile material which is diagrammatically illustrated in FIG. 3 comprises, in a chamber 2', a plurality of suspension bars 5' which circulate along a continuous path 16 in the direction of the arrow 15.

The continuous circuit 16 has an elongate, preferably substantially elliptical form and consists of upper and lower zones with a large radius of curvature and two lateral zones with a small radius of curvature.

Figure 4:
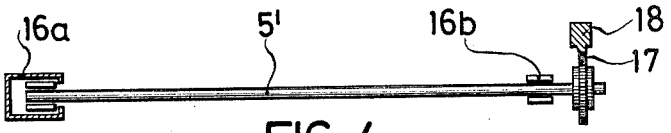
FIG. 4 is a view of a suspension bar (together with its guide path and rotation means) for the embodiment shown in FIG. 3.

In the embodiment illustrated, the elliptical circuit 16 is formed by two guide rails **16*a*, 16*b* in which suspension bars 5' are guided, as shown in FIG. 4. It is obvious that the distance between the guide rails 16*a* and 16*b*** corresponds to the largest width of the webs of textile material to be treated in the apparatus.

At its point of entry 8'', the web 1 of textile material is deposited in the form of a loop on the next free suspension bar (for example **5*a'*). To this end, there is provided a drive element (not shown) which carries the empty suspension bars (for example 5*a'*) to the entrance 8'' for the web 1 and which is formed for example by a rotating cam. The thrust applied by this drive element to the suspension bar which has just reached the entrance 8'' for the web of material is propagated in the direction of circulation (anticlockwise, arrow 15) through the suspension bars already laden with the web of material, and hence provides for the circulation of the suspension bars 5' and the web of material carried by them along the closed circuit 16**.

The suspension bars 5' initially travel from the entrance 8'' for the web of material along the elongate upper zone of the circuit, in which the web of material depends freely in the loops and has good possibilities for shrinkage.

In addition, the suspension bars 5' are turned about their axes in this zone (upper zone of the circuit 16). In the embodiment illustrated, a gearwheel 17 meshing with a fixed rack 18 is provided for this purpose on that end of the suspension bar 5' which projects beyond the guide rail **16*b*. The fixed rack 18 may even be replaced by an endless driven chain, which opens up the possibility of selecting the rotational movement of the suspension bars 5' independently of their advance along the circuit 16**.

The rotation of the suspension bars about their axes during their movement around the circuit 16 has the desirable effect of continuously shifting the points at which the textile web 1 rests on the suspension bars 5', and hence eliminates any irregularities in the shrinkage and thermal stressing of the textile web.

After the loops of the textile web 1 have been carried through the entire upper zone of the elongate circuit 16 on the suspension bars 5', they are deposited one on top of the other in the lower zone of the circuit in the manner diagrammatically illustrated. In the region of the transition to the right-hand zone of the circuit with its small radius of curvature, the loops of the textile web shift position, as indicated at 19, until finally the web of material, again depending in loops from the suspension bars, reaches the exit **9*a''*** for the web.

It can be seen that the entrance 8'' and the exit **9*a''* for the web of material are arranged off-center —staggered against the direction of circulation (arrow 15) of the suspension bars 5'—in the upper zone of the circuit 16. The effect of this shift in the entrance and exit of the web 1** towards one end of the elongate circuit is that, after it has been introduced into the assembly of suspension bars, the web of material initially depends freely and can shrink freely over a relatively long period (i.e., during the passage through the entire upper zone of the circuit).

Whereas in the embodiment illustrated in FIG. 4 the co-operating element (rack 18 or endless driven chain) meshing with the gearwheels 17 of the suspension bars 5' is arranged outside the region accommodating the web 1, between the two guide rails **16*a*, 16*b***, it is of course also possible in accordance with the invention to select an arrangement in which this co-operating element is provided between the two guide rails.

Axial displacement of the suspension bars 5' is best prevented by suitably profiling the guide rail **16*a***.

We claim:

1. Apparatus for treating a web of textile material in a dwell zone, comprising a closed circuit, a plurality of suspension bars for carrying loops of the web of material around such circuit, means for guiding the suspension bars around the closed circuit, means for feeding the web downward at a fixed entrance point in such circuit to cause each passing suspension bar to pick up a loop of the web, and means for withdrawing the web continuously at a point in such circuit immediately preceding such entrance point, wherein the circuit has an elongate form with a substantially horizontal axis, and the entrance point and point of withdrawal of the web are located in the upper portion of the circuit, substantially ahead of a vertical median plane passing through said axis, and wherein the circuit includes an upper portion, a lateral portion preceding the upper portion and a transition portion between the lateral and upper portions, and the upper portion has a radius of curvature which is larger than the radius of curvature of the preceding lateral portion, and the entrance point and point of withdrawal of the web are located adjacent to the transition portion.

2. Apparatus as claimed in claim 1, wherein the circuit is substantially elliptical.

3. Apparatus as claimed in claim 1, wherein means is provided for rotating the suspension bars in the upper portion of the circuit.

4. Apparatus as claimed in claim 3, wherein each suspension bar carries at least one gear which is driven by the means for rotating the suspension bars.

5. Apparatus as claimed in claim 1, wherein the means for rotating the suspension bars is a fixed rack.

6. Apparatus as claimed in claim 4, wherein the means for guiding the suspension bars around a closed circuit comprises two rails for guiding the two ends of each suspension bar, and both the gears on the suspension bars and the driving means are located at the outer side of one of the rails.

* * * * *